US010584841B2

(12) United States Patent
Jones et al.

(10) Patent No.: US 10,584,841 B2
(45) Date of Patent: Mar. 10, 2020

(54) FLAME SIMULATING ASSEMBLY WITH OCCLUDED SHADOW IMAGING WALL

(71) Applicant: LIVING STYLE (B.V.I) LIMITED, Tortola (VG)

(72) Inventors: Paul Jones, San Diego, CA (US); John R. Marshall, Jr., Colorado Springs, CO (US); Willard Lassen, San Diego, CA (US)

(73) Assignee: Living Style (B.V.I.) Limited, Tortola (VG)

( * ) Notice: Subject to any disclaimer, the term of this patent is extended or adjusted under 35 U.S.C. 154(b) by 0 days.

(21) Appl. No.: 16/012,738

(22) Filed: Jun. 19, 2018

(65) Prior Publication Data

US 2018/0363866 A1 Dec. 20, 2018

Related U.S. Application Data

(60) Provisional application No. 62/522,158, filed on Jun. 20, 2017.

(51) Int. Cl.

| | |
|---|---|
| ***F21S 10/04*** | (2006.01) |
| ***F21V 11/16*** | (2006.01) |
| ***F21V 7/09*** | (2006.01) |
| ***F21V 7/00*** | (2006.01) |
| ***F21V 33/00*** | (2006.01) |

(52) U.S. Cl.

CPC ..... *F21S 10/04* (2013.01); *F21V 7/00* (2013.01); *F21V 7/09* (2013.01); *F21V 11/16* (2013.01); *F21V 33/0092* (2013.01)

(58) Field of Classification Search

CPC ..... F24C 7/004; F21S 10/04; F24B 1/1808

USPC ..... 362/249.16, 806–811

See application file for complete search history.

(56) References Cited

U.S. PATENT DOCUMENTS

| | | | | |
|---|---|---|---|---|
| 3,978,598 | A * | 9/1976 | Rose | F21S 10/04 40/428 |
| 4,026,544 | A | 5/1977 | Plambeck et al. | |
| 4,203,241 | A | 5/1980 | Wallace | |
| 4,272,908 | A | 6/1981 | Bassetti et al. | |
| 4,296,154 | A | 10/1981 | Ibberson | |
| 4,726,351 | A | 2/1988 | Whittaker et al. | |
| 4,897,524 | A | 1/1990 | Brasell | |
| 4,965,707 | A | 10/1990 | Butterfield | |

(Continued)

FOREIGN PATENT DOCUMENTS

| | | |
|---|---|---|
| CN | 2924710 Y | 7/2007 |
| CN | 100354568 C | 12/2007 |

(Continued)

*Primary Examiner* — William J Carter

(74) *Attorney, Agent, or Firm* — Barlow, Josephs & Holmes, Ltd.

(57) ABSTRACT

A flame simulating assembly for providing a moving effect of flames. The assembly includes a light source; a flicker element disposed in the path of the light source configured and arranged to reflect light from the light source; and an imaging wall. The imaging wall is disposed above the light source and includes a front facet and at least one additional facet. The front facet has an upper portion disposed forward of a lower portion thereof and the at least one additional facet extending rearward from the front facet. Light from the flicker element is occluded by the front facet to provide a more realistic fire shape. The fire shape appears wider at the base than at the top.

12 Claims, 4 Drawing Sheets

(56) References Cited

U.S. PATENT DOCUMENTS 5,003,158 A 3/1991 Erkki
5,099,591 A 3/1992 Eiklor et al.
5,195,820 A 3/1993 Rehberg
5,635,898 A 6/1997 Walters et al.
5,642,580 A 7/1997 Hess et al.
5,774,040 A 6/1998 Lastoria
5,826,357 A 10/1998 Hechler
5,887,369 A 3/1999 Danielczak
5,980,059 A 11/1999 Chi
5,989,128 A 11/1999 Baker et al.
6,047,489 A 4/2000 Hess et al.
6,050,011 A 4/2000 Hess et al.
6,053,165 A 4/2000 Butler et al.
6,082,868 A 7/2000 Carpenter
6,135,604 A 10/2000 Lin
6,152,728 A 11/2000 Griffel
6,155,837 A 12/2000 Korneliussen
6,162,047 A 12/2000 Hess
6,190,019 B1 2/2001 Hess
6,269,567 B1 8/2001 MacPherson et al.
6,302,555 B1 10/2001 Bristow
6,312,137 B1 11/2001 Hsich
6,350,498 B1 2/2002 Hess et al.
6,363,636 B1 4/2002 Hess et al.
6,385,881 B1 5/2002 Hess
6,393,207 B1 5/2002 Martin et al.
6,454,425 B1 9/2002 Lin
6,461,011 B1 10/2002 Harrison
6,554,443 B2 4/2003 Fan
6,564,485 B1 5/2003 Hess
6,615,519 B2 9/2003 Hess
6,685,574 B2 2/2004 Hall
6,691,440 B1 2/2004 Petz et al.
6,718,665 B2 4/2004 Hess et al.
6,757,487 B2 6/2004 Martin et al.
6,758,575 B2 7/2004 Winkler
6,802,782 B2 10/2004 Hall et al.
6,880,275 B2 4/2005 Mix et al.
6,919,884 B2 7/2005 Mix et al.
6,944,982 B2 9/2005 Schroeter et al.
6,953,401 B2 10/2005 Starr
6,955,440 B2 10/2005 Niskanen
6,966,665 B2 11/2005 Limburg et al.
6,968,123 B2 11/2005 Ravnbo-West et al.
7,080,472 B2 7/2006 Schroeter et al.
7,093,949 B2 8/2006 Hart et al.
7,111,421 B2 9/2006 Corry et al.
7,134,229 B2 11/2006 Hess et al.
7,162,820 B2 1/2007 Hess et al.
7,194,830 B2 3/2007 Hess
7,219,456 B1 5/2007 Wei et al.
7,234,255 B2 6/2007 Peng et al.
7,236,693 B2 6/2007 Haugom
7,281,811 B2 10/2007 Thuot Rann et al.
7,300,179 B1 11/2007 LaDuke et al.
7,305,783 B2 12/2007 Mix et al.
7,322,136 B2 1/2008 Chen
7,322,819 B2 1/2008 Lyons et al.
7,334,360 B1 * 2/2008 Corry ..... G09F 19/12 40/428
7,373,743 B1 5/2008 Hess
7,481,571 B2 1/2009 Bistritzky et al.
7,556,408 B2 7/2009 Thomson
7,651,230 B2 * 1/2010 O'Neill ..... F21S 10/04 362/810
7,668,442 B2 2/2010 O'Neill
7,670,035 B2 3/2010 Tsai
7,673,408 B2 3/2010 Hess et al.
7,686,471 B2 3/2010 Reichow
7,726,300 B2 6/2010 Lyons et al.
7,744,232 B2 6/2010 Gruenbacher et al.
7,762,897 B2 7/2010 Starr et al.
7,770,312 B2 8/2010 Stinson et al.
7,775,457 B2 8/2010 Schnuckle
7,784,959 B2 8/2010 Yang
7,798,673 B2 9/2010 Yang
7,815,328 B2 10/2010 Van Dyn Hoven
7,824,051 B2 11/2010 Walter et al.
7,826,727 B2 11/2010 Bourne
7,850,533 B2 12/2010 Osterman et al.
7,921,585 B2 4/2011 Wei et al.
7,967,690 B2 6/2011 O'Neill
8,019,207 B2 9/2011 Zhou
8,024,877 B2 9/2011 Zhu
8,081,872 B2 12/2011 Wang
8,136,276 B2 3/2012 O'Neill
8,151,498 B2 4/2012 Zhu
8,157,425 B2 4/2012 Gutstein et al.
8,166,687 B2 5/2012 Zhu
8,230,626 B2 7/2012 Abileah et al.
8,234,803 B2 8/2012 Gallo et al.
8,250,792 B2 8/2012 Zhu
8,356,435 B2 1/2013 Chen
8,361,367 B2 1/2013 Hess et al.
8,412,028 B2 4/2013 Zhu
8,413,358 B2 4/2013 Betz et al.
8,480,937 B2 7/2013 Hess et al.
8,523,692 B2 9/2013 Osterman et al.
8,574,086 B2 11/2013 O'Neill
8,579,453 B1 11/2013 Cohen et al.
8,628,223 B2 1/2014 Kwok et al.
8,641,214 B1 2/2014 Batchko
8,661,721 B2 3/2014 Hess et al.
8,671,600 B2 3/2014 Lu
8,695,247 B1 4/2014 Yang
8,713,825 B2 5/2014 Lu
8,739,439 B2 6/2014 Asofsky et al.
8,763,926 B2 7/2014 Powell et al.
8,783,888 B2 7/2014 McCavit et al.
8,904,680 B1 12/2014 Trovillion
8,904,681 B2 12/2014 Pan
9,459,010 B2 10/2016 Asofsky et al.
9,476,596 B2 10/2016 Asofsky et al.
2002/0023376 A1 2/2002 Hess
2002/0095832 A1 7/2002 Hess et al.
2002/0139021 A1 10/2002 Hess et al.
2002/0152655 A1 10/2002 Merrill et al.
2002/0166554 A1 11/2002 Berg
2002/0168182 A1 11/2002 Martin et al.
2002/0174579 A1 11/2002 Corry et al.
2003/0041491 A1 3/2003 Mix
2003/0046837 A1 3/2003 Hess
2003/0049024 A1 3/2003 Chen
2003/0053305 A1 3/2003 Lin
2003/0110671 A1 6/2003 Hess
2003/0156828 A1 8/2003 Jamieson et al.
2004/0060554 A1 4/2004 Schlosser et al.
2004/0114351 A1 6/2004 Stokes et al.
2004/0165374 A1 8/2004 Robinson
2004/0181983 A1 9/2004 Hess et al.
2004/0264169 A1 12/2004 Limburg et al.
2004/0264949 A1 12/2004 Deng
2005/0063685 A1 3/2005 Bristow
2005/0097792 A1 5/2005 Naden
2005/0207155 A1 9/2005 Jian
2006/0002102 A1 1/2006 Leonard
2006/0101681 A1 5/2006 Hess et al.
2006/0162198 A1 7/2006 Hess et al.
2006/0188831 A1 8/2006 Hess et al.
2006/0230656 A1 10/2006 Spengler
2006/0242870 A1 11/2006 Atemboski et al.
2007/0053174 A1 3/2007 Lin
2007/0175074 A1 8/2007 O'Neill
2008/0004124 A1 1/2008 O'Neill
2008/0013931 A1 1/2008 Bourne
2008/0037254 A1 2/2008 O'Neill
2008/0138050 A1 6/2008 Moreland et al.
2008/0181587 A1 7/2008 Patil et al.
2008/0181588 A1 7/2008 Gorby
2008/0216366 A1 9/2008 Purton et al.
2008/0216818 A1 9/2008 Rumens et al.
2008/0226268 A1 9/2008 O'Neill et al.
2009/0071047 A1 3/2009 O'Neill
2009/0074390 A1 3/2009 Power et al.

(56) References Cited

U.S. PATENT DOCUMENTS

| | | | |
|---|---|---|---|
| 2009/0080871 | A1 | 3/2009 | Chiu |
| 2009/0126241 | A1 | 5/2009 | Asofsky |
| 2009/0313866 | A1 | 12/2009 | Wang |
| 2010/0031543 | A1 | 2/2010 | Rice et al. |
| 2010/0122480 | A1 | 5/2010 | O'Neill |
| 2010/0162600 | A1 | 7/2010 | Betz et al. |
| 2010/0229849 | A1 | 9/2010 | Asofsky et al. |
| 2010/0307040 | A1 | 12/2010 | O'Neill |
| 2011/0080261 | A1 | 4/2011 | Asofsky et al. |
| 2011/0110073 | A1 | 5/2011 | Schnuckle et al. |
| 2013/0031816 | A1 | 2/2013 | Deng |
| 2013/0139422 | A1 | 6/2013 | Lu et al. |
| 2013/0223043 | A1 | 8/2013 | Ray |
| 2013/0269227 | A1 | 10/2013 | Hess et al. |
| 2014/0044423 | A1 | 2/2014 | Chu |
| 2014/0126182 | A1 | 5/2014 | Doud |
| 2014/0130386 | A1 | 5/2014 | Lu |
| 2014/0140042 | A1 | 5/2014 | Schreiber |
| 2014/0168946 | A1 | 6/2014 | Kaplan |
| 2014/0268652 | A1 | 9/2014 | Li |
| 2014/0305013 | A1 | 10/2014 | Peterson |
| 2014/0313694 | A1 | 10/2014 | Patton et al. |
| 2014/0334129 | A1 | 11/2014 | McCavit et al. |
| 2014/0373406 | A1 | 12/2014 | Flynn et al. |
| 2015/0052791 | A1 | 2/2015 | Lu |
| 2015/0068079 | A1 | 3/2015 | O'Neill |
| 2015/0113840 | A1 | 4/2015 | Yang et al. |
| 2015/0131262 | A1 | 5/2015 | Mabry, Jr. et al. |
| 2015/0253013 | A1 | 9/2015 | Fulkerson |
| 2015/0338086 | A1 | 11/2015 | Patton |
| 2015/0338087 | A1 | 11/2015 | Fang |
| 2015/0338105 | A1 | 11/2015 | Lu |
| 2015/0377492 | A1 | 12/2015 | Tynes |
| 2016/0109081 | A1 | 4/2016 | Thompson et al. |
| 2016/0169528 | A1 | 6/2016 | Lu |
| 2016/0169537 | A1 | 6/2016 | Lu |
| 2016/0195277 | A1 | 7/2016 | Li |
| 2017/0089587 | A1 | 3/2017 | Nemes et al. |

FOREIGN PATENT DOCUMENTS

| | | | |
|---|---|---|---|
| CN | 201662135 | U | 12/2010 |
| CN | 202521701 | U | 11/2012 |
| CN | 205536076 | U | 8/2016 |

* cited by examiner

FLAME SIMULATING ASSEMBLY WITH OCCLUDED SHADOW IMAGING WALL

CROSS-REFERENCE TO RELATED APPLICATIONS

This application is related to and claims benefit of U.S. Provisional Application No. 62/522,158 filed Jun. 20, 2017, the entire contents of which are incorporated herein by reference.

BACKGROUND

1. Technical Field

The present patent document relates generally to artificial or simulated fireplaces and stoves, and more particularly to a flame simulating assembly with an occluded shadow imaging wall.

2. Background of the Related Art

In simulated fireplaces, electronic flames, or simulated flames, are often used in a flame simulator to provide the simulated fireplace an optical visual effect and to play a role in decoration. In one type of flame simulator, a light source and rotating reflector is installed behind a slotted flame-shaped wall. As the reflector rotates, light is periodically emitted through the flame-shaped wall and onto a screen, which simulates the flames by providing a flickering effect to the light projected through the slotted wall. The reflector may also be referred to as a flicker element.

The light may optionally be reflected off a mirror and onto the screen. The light may be projected onto the front of the screen or, with a light-transmitting screen, onto the rear of the screen. In either case the screen is flat and, consequently, the simulated flame lacks depth. Furthermore, the brightness of the flame tends to be more uniform, which detracts from the visual appearance.

Therefore, there is a perceived need in the industry for a simulated flame with enhanced depth and brightness that more closely resembles a real flame.

SUMMARY

The present invention solves the problems of the prior art by providing a flame simulating assembly with an occluded shadow imaging wall that is shaped in such a way that light from a flicker element is most intense in the center but fades out towards the corners. The overall shape of the simulated fire is triangular, which more closely simulates a real fire.

BRIEF DESCRIPTION OF THE DRAWINGS

These and other features, aspects, and advantages of the present invention will become better understood with reference to the following description, appended claims, and accompanying drawings where:

DESCRIPTION OF THE EXEMPLARY EMBODIMENTS

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Figure 1:
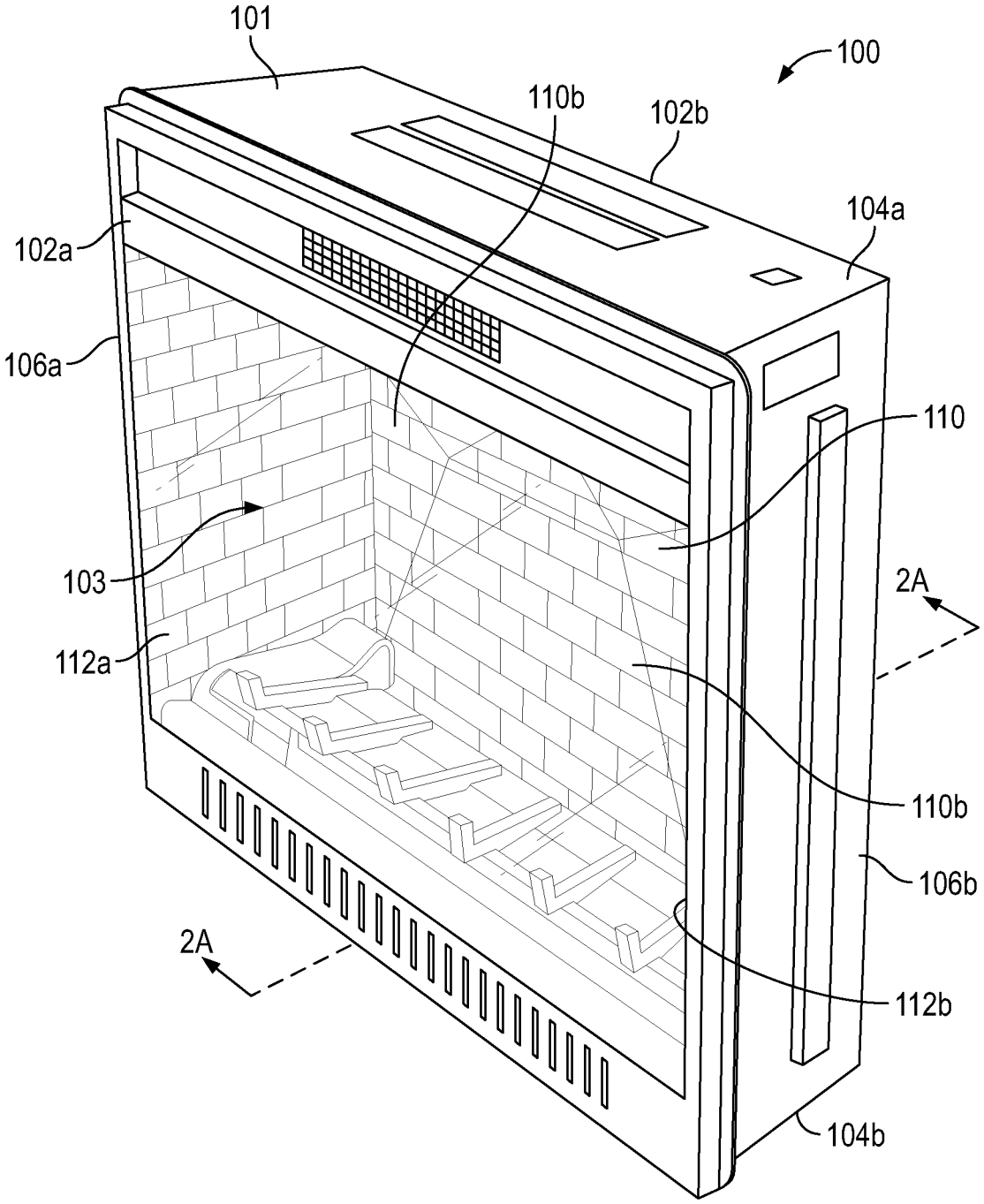
FIG. 1 is a perspective view of an exemplary embodiment of an electric fireplace.

In an exemplary embodiment, illustrated in FIG. 1, an electric fireplace 100 can include a housing, or enclosure, 101 having front and back walls 102*a*, 102*b*, top and bottom walls 104*a*, 104*b*, and side walls 106*a*, 106*b*. Through an opening in the front wall 102*a* a firebox cavity 103 can be defined which is visible through a transparent glass panel or a set of glass doors (not shown). The firebox cavity 103 can be defined by a firebox rear wall 110, firebox top and bottom walls, and firebox side walls 112*a*, 112*b*. The firebox cavity 103 can create the appearance of a traditional fireplace firebox. The side walls 112*a*, 112*b* and the rear wall 110 may or may not be given the appearance of brick or stone to provide an authentic look and feel. The side walls 112*a*, 112*b* may or may not be angled relative to the rear wall 110. In some embodiments, a gradation of color from a central location on the firebox rear wall 110 to the firebox side walls may provide the illusion of soot build-up towards the outer edges while also providing a brighter, lighter central portion for enhanced reflection and flame appearance in the center. For example, a central portion may be yellow, red, brown, or brick colored, and the color can then fade to a black, grey, or generally soot-like color as it extends away from the central portion forming a gradation. Alternatively, the firebox side walls 112*a*, 112*b* and the firebox rear wall 110 can have any appearance, texture, or color.

The interior of the housing can provide space for various internal components of the electric fireplace, including a heater/blower unit (not shown in this embodiment) which provides a warm air flow from the fireplace unit 100 and further including a flame simulation assembly which provides the visual effect of moving flames on the firebox rear wall 110. The flame simulation assembly can include those disclosed in U.S. patent application Ser. No. 16/004,767, filed Jun. 11, 2018, titled "FLAME SIMULATING ASSEMBLY FOR SIMULATED FIREPLACES INCLUDING A REFLECTING LIGHT SYSTEM," hereby incorporated by reference in its entirety. In an exemplary configuration, the heater is located in a compartment at the top of the housing. However, in alternative embodiments, the heater can be disposed in other areas of the device. In general, the heater/blower unit can be controlled, with a controller (not shown), to provide hot air to heat the surrounding area to further add to the realism of the electric fireplace and its' utility as a space heater. The controller can additionally be used to control the flame simulation assembly and any other feature of the device.

Figure 2A:
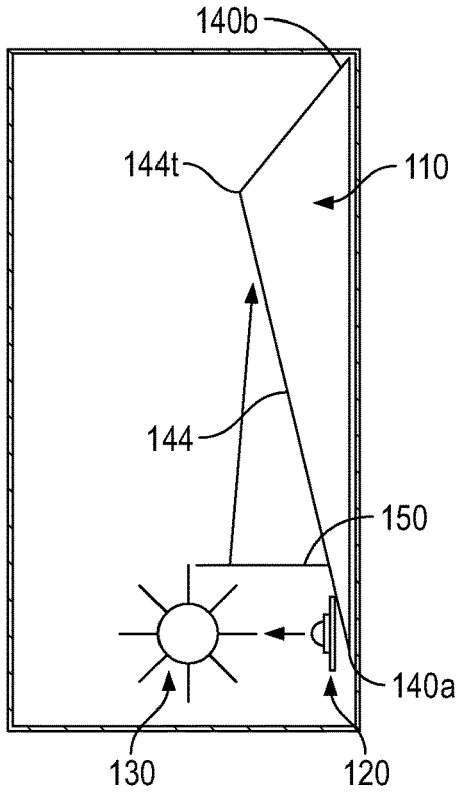
FIG. 2A is a side view of an exemplary embodiment of a flame simulating assembly.
Figure 2B:
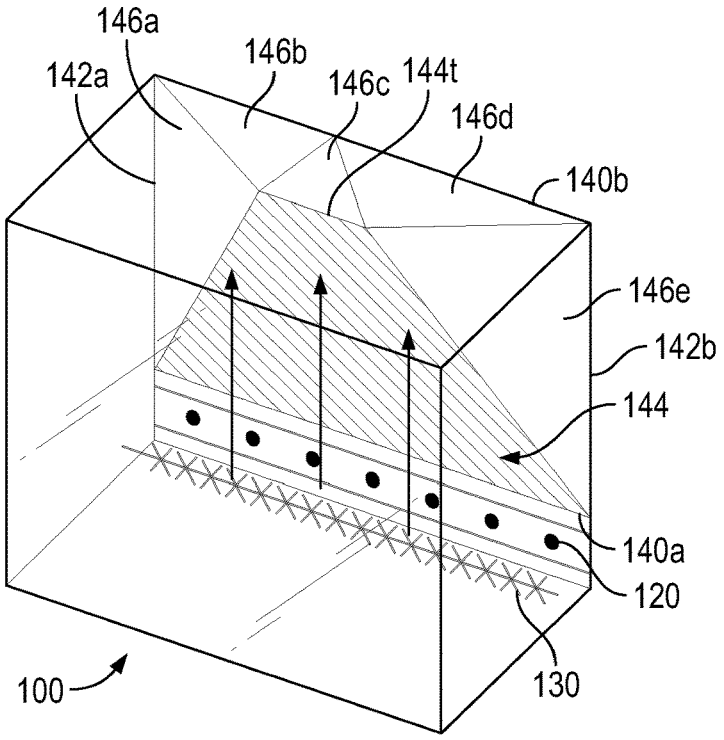
FIG. 2B is an isometric view of the exemplary embodiment of a flame simulating assembly of FIG. 2A.

Referring now to FIGS. 2A and 2B, an embodiment of a flame simulating assembly is shown generally in several views. The assembly generally includes an enclosure housing a light source 120, a flicker element 130, and a unique rear imaging wall 110. Light from the light source 120 can be directed towards the flicker element 130. The light can then be reflected upwards and/or rearwards towards a slotted wall, or flame screen 150 as shown in U.S. application Ser. No. 16/004,767 and onto the imaging wall 110 thereby simulating the flame. In alternative embodiments, the flame screen can be omitted.

The imaging wall 110 may be generally rectangular or square in shape, when viewed from the front, with a bottom edge 140*a*, a top edge 140*b*, a left edge 142*a*, and a right edge 142*b* with corners. In the illustrated embodiment, the top portion 144*t*, proximate the top edge 140*b* projects forward of the bottom edge 140*a* in the enclosure and is therefore laterally closer to the flicker element 130 than the bottom edge 140*a*. In some embodiments, the imaging wall 110 may not occupy the entire rear wall of the firebox 103. The most critical portion of the imaging wall is the generally triangular central portion 144 which acts to image and shape the light forwardly and toward the top into the triangular shape of a fire. In some embodiments, the top portions 146*b*, 146*c*, 146*d* and side portions 146*a* and 146*e* may taper off into the back wall or may be eliminated altogether providing an occluded shadow area. In some embodiments, where the side and/or top portions are eliminated, the terminal edges or seams of the central portion 144 may include serrated or flame shaped edges.

Referring to FIGS. 2A-2B, an exemplary embodiment is illustrated where the imaging wall has a generally polyhedral shape, with a front facet area 144 to reflect light and the remaining facets 146*a-e* to form shadows and occlusions to enhance the appearance of a simulated flame. The imaging wall 110 can be manufactured by any suitable means including blow molding, vacuum molding, injection molding, 3D printing, or may be fabricated from sheet metal pieces, etc. Although the term "facet" is utilized to define the general areas, and linear "seams" are illustrated between the facet areas, it is to be understood that the term is intended to generally describe the shapes and that the "seams" between the facet areas do not need to be sharp angles. The transition from one facet area to another can be smooth and seamless with the same effect.

As illustrated, the front facet 144 has a general trapezoidal shape, with a top edge 144*t* of the facet 144 disposed forward of both the bottom and top edges of the wall 140*a*, 140*b*. The top edge 144*t* of the facet 144 can have a shorter length then the bottom edge of the facet 144 which can extend the entire length of the bottom edge 140*b* of the imaging wall 110. The remaining facets 146*a-e* are angled away from the flicker element and light source, thus eliminating or reducing light reflected onto these other facets. The remaining facets 146*a-e* each extend from the front facet towards a respective bottom, top, left, or right edge 140*a*, 140*b*, 142*a*, 142*b*. As shown, the remaining facets 146*a-e* are triangular in shape, however other shapes that are angled relative to the front facet 144 are considered to be within the scope of this disclosure, including square, trapezoidal, etc. In some embodiments, some of the remaining facets 146*a-e* can each be different shapes or can be the same shapes with different proportions. While five remaining facets 146*a-e* are shown, any number of additional facets can be provided. Due to the remaining facets 146*a-e* being angled relative to the front facet 144, the light that is reflected from the flicker element 130 may not, relatively, brightly reflect off of those facets 146*a-e*. As a result of the angle relative to the front facet 144, the remaining facets 146*a-e* appear darker and the front facet 144 appears brighter, thus providing an enhanced triangular shape to the simulated flame. Further, or alternatively, the remaining facets 146*a-e* can have a non-reflective coating or dark paint to prevent any light from reflecting off the wall. Or as indicated above, the remaining facets may be eliminated.

Figure 3A:
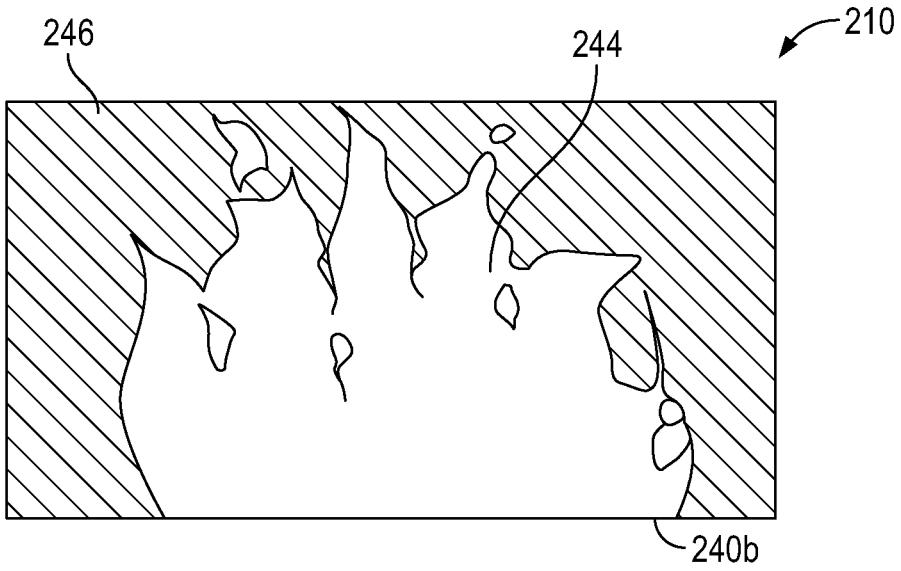
FIG. 3A is a front view of another exemplary embodiment of a back wall of a flame simulating assembly.
Figure 3B:
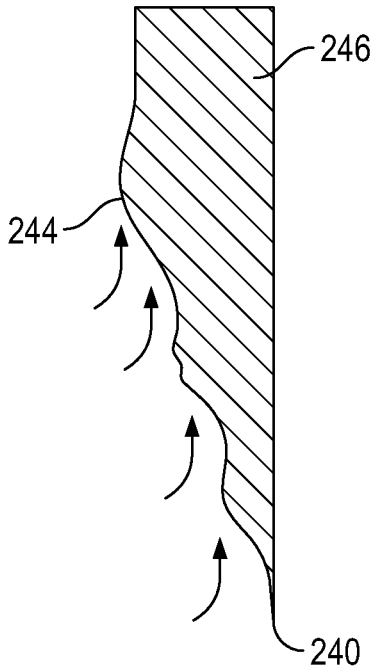
FIG. 3B is a side view of the exemplary embodiment of a flame simulating assembly of FIG. 3A.

The imaging wall 210 may alternatively include a 3-Dimensional (3D) flame shape 244 molded thereon, as shown in FIGS. 3A and 3B. The flame shape 244 is generally an impression formed into the front surface of the forwardly angled imaging wall and can be in place of the trapezoidal front facet 244 and be angled forward from its bottom edge 240*b* towards the front of the fireplace enclosure. The alternative imaging wall 210 can be manufactured by any suitable means including blow molding, vacuum molding, injection molding, 3D printing, or fashioned from sheet metal pieces, etc. The imaging 210 wall may further include dark colors formed outside the flame shaped molded section 246, thereby providing a shadow boundary that reduces reflection of the simulated flame light. The darker, non-reflective, area 246 can enhance the shape of the simulated flame to appear more triangular in shape.

Figure 4A:
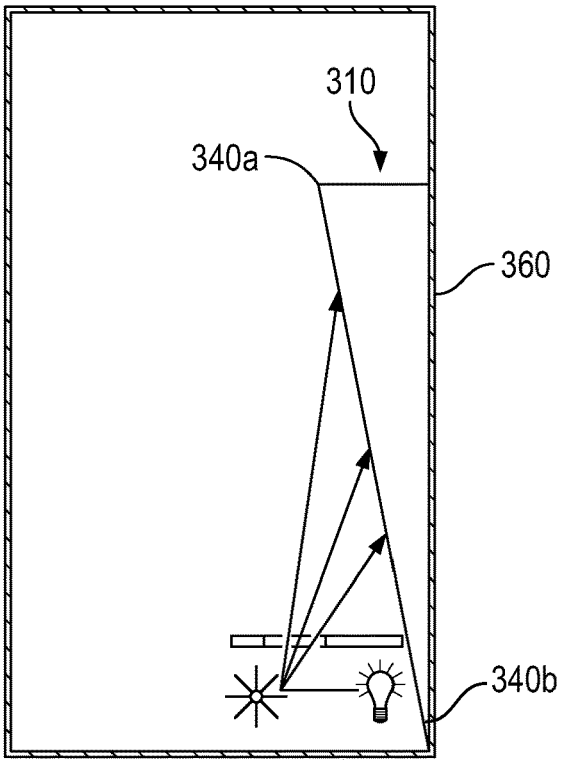
FIG. 4A is a side view of another exemplary embodiment of a back wall of a flame simulating assembly.
Figure 4B:
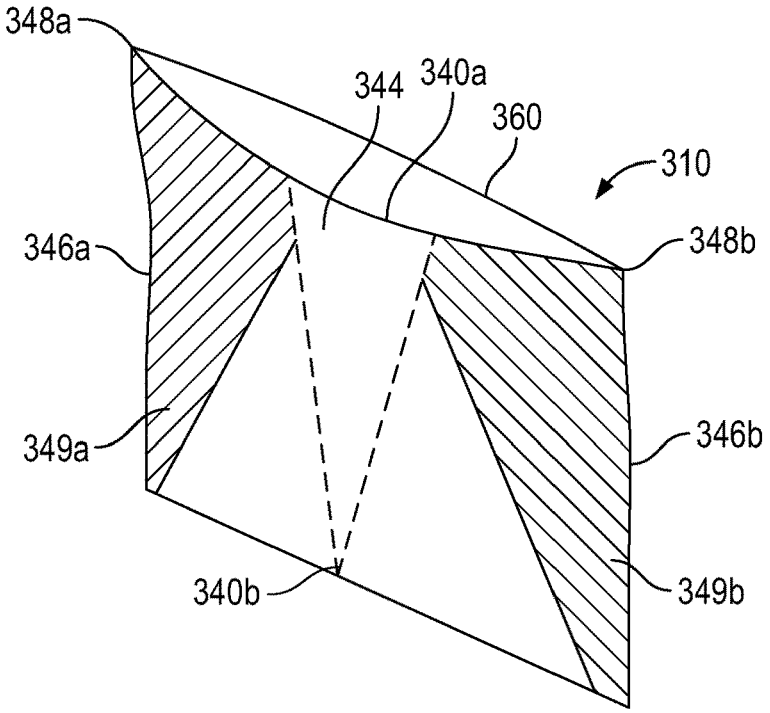
FIG. 4B is an isometric view of the exemplary embodiment of a flame simulating assembly of FIG. 4A.

Referring to FIGS. 4A and 4B, a further exemplary embodiment of an imaging wall 310 is shown where a top edge 340*a* of the imaging wall 310 is bowed outwardly to form a semicircular or arc shape at the top edge and a straight line at the bottom edge 340*b*. The imaging wall 310 can be formed from a single sheet of material that is bowed outward as described and applied or attached to the rear wall of the fireplace. The alternative imaging wall 310 can alternatively be manufactured by any suitable means including blow molding, vacuum molding, injection molding, 3D printing, or fashioned from sheet metal or plastic, etc. As a result, a center portion 344 of the imaging wall 310 is laterally forward of the bottom edge 340*b*. The left and right corners 348*a*, 348*b* of the top edge 340*a* can be disposed rearward of the center section 344. This configuration can provide an imaging surface 344 on the imaging wall that has a parabolic, triangular, or trapezoidal flame image area. Consequently, the left and right sides 346*a*, 346*b* and left and right upper corners 348*a*, 348*b* can form enhanced occlusions or shadow areas 349*a*, 349*b* that are blocked from the projected simulated flame which can thus enhance the realism of the flame. In some embodiments, the imaging wall 310 may not occupy the entire rear portion of the firebox 103. The imaging wall may be prominent in the center portion or area and then be truncated or eliminated toward the outer edges. In some embodiments, the imaging wall 310 may be fashioned from a transparent, coated or partially reflective plastic material and the flat inner surface of the rear wall 360 is provided with a brick pattern. In this manner, light is reflected from the curved forward imaging surface 340, while the brick pattern still appears flat on the back surface 360.

Although the embodiments are shown with a reflection system, it would be appreciated by one skilled in the art that the simulated flame assembly described herein may be adapted for a rear projection configuration, or an indirect reflection using one or more mirrors or screens.

Therefore, it can be seen that the simulated flame assembly provides a unique solution to the problems of the prior art by providing a simulated flame assembly with an occluded shadow imaging wall with enhanced depth and brightness that more closely resembles a real flame.

It would be appreciated by those skilled in the art that various changes and modifications can be made to the illustrated embodiments without departing from the spirit of the present invention. All such modifications and changes are intended to be within the scope of the present invention.

What is claimed:

1. A flame simulating assembly for providing a moving effect of flames, the assembly comprising:

a light source;

a flicker element disposed in the path of the light source configured and arranged to reflect light from the light source; and an imaging wall disposed above the light source, the imaging wall including a front facet area having a base which is wider than a top, wherein the top is forward of the base, and wherein the front facet has a trapezoidal shape, wherein light reflected from the flicker element is occluded by the front facet area to provide a more realistic fire shape, wherein the fire shape appearing wider at the base than at the top, wherein the imaging wall includes at least one additional facet area, the front facet area having an upper portion disposed forward of a lower portion thereof and the at least one additional facet area extending rearward from the front facet area, and wherein the at least one additional facet area has a triangular shape.

2. The flame simulating assembly of claim 1, wherein the front facet area is at least partially reflective.

3. The flame simulating assembly of claim 1, wherein the at least one additional facet area is non-reflective.

4. The flame simulating assembly of claim 3, wherein the at least one additional facet area is a darker color than the front facet area.

5. The flame simulating assembly of claim 1, wherein the front facet area includes a 3D impression of flame shapes.

6. The flame simulating assembly of claim 1, wherein the front facet has a flame shape.

7. The flame simulating assembly of claim 1, wherein the imaging wall is constructed from a single piece of material.

8. The flame simulating assembly of claim 1, further comprising, a flame cut out, wherein light is reflected off the flicker element upwardly through the flame cut out before illuminating the imaging wall.

9. A flame simulating assembly for providing a moving effect of flames, the assembly comprising:

a light source;

a flicker element disposed in the path of the light source configured and arranged to reflect light from the light source; and an imaging wall disposed above the light source, the imaging wall including an upper edge extending from a first side to a second side, the upper edge being curved arcuately forward from the first and second sides towards a center thereof to form an arcuate bowed shape at said upper edge, and further including a lower edge that is disposed below the upper edge, wherein light from the flicker element is occluded by the imaging wall to provide a more realistic fire shape, and wherein the fire shape created by said light source and said flicker element appearing wider at the lower edge than at the top edge.

10. The flame simulating assembly of claim 9, wherein said center of the top edge is laterally closer to the flicker element than the first and second upper corners.

11. The flame simulating assembly of claim 9, wherein the lower edge of the imaging wall is disposed behind the light source.

12. The flame simulating assembly of claim 9, further comprising, a flame cut out, wherein light is reflected off the flicker element upwardly through the flame cut out before illuminating the imaging wall.

* * * * *